US006657417B1

(12) United States Patent
Hwang

(10) Patent No.: US 6,657,417 B1
(45) Date of Patent: Dec. 2, 2003

(54) POWER FACTOR CORRECTION WITH CARRIER CONTROL AND INPUT VOLTAGE SENSING

(75) Inventor: Jeffrey H. Hwang, Saratoga, CA (US)

(73) Assignee: Champion Microelectronic Corp. (TW)

( * ) Notice: Subject to any disclaimer, the term of this patent is extended or adjusted under 35 U.S.C. 154(b) by 0 days.

(21) Appl. No.: 10/159,142

(22) Filed: May 31, 2002

(51) Int. Cl.[7] ..... G05F 1/70; G05F 1/613

(52) U.S. Cl. ..... 323/222; 323/207; 363/84; 363/89

(58) Field of Search ..... 323/222, 207, 323/223, 282, 226, 284; 363/84, 89

(56) References Cited

U.S. PATENT DOCUMENTS

| | | | | | |
|---|---|---|---|---|---|
| 3,896,348 | A | * | 7/1975 | Loderer | 388/819 |
| 4,146,832 | A | * | 3/1979 | McConnell | 323/285 |
| 5,396,165 | A | | 3/1995 | Hwang et al. | 323/210 |
| 5,565,761 | A | | 10/1996 | Hwang | 323/222 |
| 5,592,128 | A | | 1/1997 | Hwang | 331/61 |
| 5,742,151 | A | | 4/1998 | Hwang | 323/222 |
| 5,764,039 | A | * | 6/1998 | Choi et al. | 323/222 |
| 5,798,635 | A | | 8/1998 | Hwang et al. | 323/222 |
| 5,804,950 | A | | 9/1998 | Hwang et al. | 323/222 |
| 5,867,379 | A | | 2/1999 | Maksimovic et al. | 363/89 |
| 5,903,138 | A | | 5/1999 | Hwang et al. | 323/266 |
| 6,091,233 | A | | 7/2000 | Hwang et al. | 323/222 |
| 6,222,746 | B1 | * | 4/2001 | Kim | 363/89 |

OTHER PUBLICATIONS

Bourgeois, J.M. "Application Note: Circuits for Power Factor Correction with Regards to Mains Filtering." SGS–Thompson Microelectronics, 1997.

"Top 232–234 TOPSwitch–FX Family; Design Flexible, EcoSmart, Integrated Off–line Switcher" Power Integrations, Inc., Jul. 2001.

Maksimovic, Dragan, Yungtaek Jang, and Robert W. Erickson. "Nonlinear–Carrier Control for High–Power–Factor Boost Rectifiers" *IEEE Transactions on Power Electronics* vol. 11 No. 4 (Jul. 1996): p. 578–84.

* cited by examiner

*Primary Examiner*—Bao Q. Vu
(74) *Attorney, Agent, or Firm*—Derek J. Westberg

(57) ABSTRACT

A switching power supply which uses carrier control and input voltage sensing. In one aspect, an output voltage is monitored to form a carrier signal. The carrier signal is compared to a signal that is representative of the input current in order to control the switching duty cycle. In addition, a signal representative of the input voltage is summed with the signal that is representative of the input current, or with the carrier signal, in order to effectively control the switching duty cycle under light load conditions and conditions in which the input voltage can vary.

43 Claims, 10 Drawing Sheets

POWER FACTOR CORRECTION WITH CARRIER CONTROL AND INPUT VOLTAGE SENSING

RELATED APPLICATION DATA

This application is related to U.S. application Ser. No.10/159,142, filed on the same day and entitled, "Switching Power Supply Having Alternate Function Signal."

FIELD OF THE INVENTION

The present invention relates to the field of switching power supplies. More particularly, the present invention relates to switching power supplies that perform power factor correction using a carrier control and input voltage sensing.

BACKGROUND OF THE INVENTION

Switching power supplies generally operate by modulating current from a power source using a switch. The switch is typically a transistor capable of handling significant current levels, such as a power metal oxide semiconductor field-effect transistor (MOSFET) or insulated gate bipolar transistor (IGBT). When the switch is closed, current passes through the switch, charging a reactive element with energy. When the switch is opened, the energy is discharged into a storage element, forming an output voltage. Opening and closing of the switch is generally controlled with feedback so as to regulate the output voltage at a constant level. The output voltage may be used to power a load or may be connected as an input to another power supply stage.

Some switching power supplies convert power from an alternating-current (AC) power source. Such a switching power supply may be referred to as an off-line power supply. An off-line power supply preferably presents a substantially resistive load to the AC source so as to avoid contaminating the AC source. In other words, the current drawn during the switching operations is substantially in phase with the voltage of the AC source. Power factor correction (PFC) is a technique for ensuring that the input current is in phase with the AC supply voltage.

There are generally two types of switching power supplies that perform power factor correction. A first type is known as average current-mode control. A circuit diagram of a switching power supply which performs power factor correction using average current-mode control is illustrated in FIG. 1. A line voltage is coupled to the input terminals of a full wave bridge rectifier 18. A first output terminal of the full wave bridge rectifier 18 is coupled to a first terminal of an inductor L1 and to a first input terminal of a multiplier 20. A second terminal of the inductor L1 is coupled to a drain of an NMOS transistor SW1 and to an anode of a diode SW2. A source of the NMOS transistor SW1 is coupled to the ground node.

A cathode of the diode SW2 is coupled to a first terminal of a capacitor C1 and to an output node Vout. A second terminal of the capacitor C1 is coupled to the ground node. Opening and closing of the transistor switch SW1 causes the current iL to flow in the inductor L1. The capacitor C1 is charged to a level which depends on the duty cycle at which the transistor switch SW1 is operated.

A first terminal of a resistor R1 is coupled to the output node Vout. A second terminal of the resistor R1 is coupled to a negative input of a error amplifier 10 and to a first terminal of a resistor R2. A second terminal of the resistor R2 is to the ground node. A positive input of the amplifier 10 is coupled to a reference voltage Vref. An output of the amplifier 10 forms an error signal which is representative of a difference between the output voltage Vout and a desired level for the output voltage Vout and is coupled to a second input of the multiplier 20.

An output of the multiplier 20 is coupled to a positive input terminal of a current error amplifier 22 and to a first terminal of a resistor Ra. A second terminal of the resistor Ra is coupled to a second output terminal of the full wave bridge rectifier 18 and to a first terminal of a sense resistor Rs. A second terminal of the sense resistor Rs is coupled to a first terminal of a resistor Rb and to the ground node. A second terminal of the resistor Rb is coupled to a negative input terminal of the amplifier 22. An output of the current error amplifier 22 is coupled to a negative input terminal of a modulating comparator 14. A linear periodic ramp output of the oscillator 12 is coupled to a positive input terminal of the modulating comparator 14. The ramp output of the oscillator 12 is formed by charging a capacitor with a constant current. An output of the modulating comparator 14 is coupled as an input R of a flip-flop 16. A clock output of the oscillator 12 is coupled as an input S of the flip-flop 16. An output Q of the flip-flop 16 is coupled to a gate of the NMOS transistor SW1.

A feed-forward signal from the full wave bridge rectifier 18 which senses the input voltage of the AC source is applied to one of the inputs of the multiplier 20. The other input to the multiplier 20 is the output of the voltage error amplifier 10.

The output of the multiplier 20 is a current which is the product of the reference current, the output of the voltage error amplifier 10 and a gain adjustor factor. This output current is applied to the resistor Ra. The voltage across the resistor Ra subtracts from the sensed voltage across the sense resistor Rs and is applied to the current error amplifier 22. Under closed loop control, the current error amplifier 22 will adjust the switching duty cycle try to keep this voltage differential near the zero volt level. This forces the voltage produced by the return current flowing through the sense resistor Rs to be equal to the voltage across the resistor Ra and, thus, forces the input current to follow the input voltage.

The amplified current error signal output from the current error amplifier 22 is then applied to the negative input to the modulating comparator 14. The other input to the modulating comparator 14 is coupled to receive the ramp signal output from the oscillator 12. Pulse width modulation is obtained when the amplified error signal that sets up the trip point modulates up and down. When compared to the linear ramp signal from the oscillator 12, this adjusts the switching duty cycle.

Thus, a current control loop modulates the duty cycle of the switch SW1 in order to force the input current to follow the waveform of the full wave rectified sine wave input voltage. The current control loop and the power delivery circuitry must have at least enough bandwidth to follow this waveform. The above-described average current-mode technique for power factor correction is characterized in that it requires AC input voltage sensing to obtain a sinusoidal reference signal, an analog multiplier to multiply this reference signal with the output voltage error signal, and a linear ramp signal formed by a constant current. By multiplying the AC input voltage sensing signal by the output voltage error signal, the input current is forced (by the amplifier 22 maintaining its inputs at equal voltage potential) to follow the input voltage in a tightly-controlled feedback loop. Thus, implementation of average current-mode control tends to require complex implementation which tends to increase the cost of such a switching power supply.

A second type of switching power supply that performs power factor correction is known as non-linear carrier control. A circuit diagram of a switching power supply which performs power factor correction using a non-linear carrier is illustrated in FIG. 2.

The switching power supply of FIG. 2 is described in an article by Dragan Maksimovic, Yungtaek Jang and Robert Erickson, entitled "Nonlinear-Carrier Control For High Power Factor Boost Rectifiers,"EEE Transactions on Power Electronics, Vol. 11, No. 4, July 1996, pp. 578–584. The power factor controller proposed by Maksimovic et al. integrates the current through the switch and compares it with a non-linear parabolic carrier waveform in order to control the duty cycle of the switch. This eliminates the input voltage sensing, the current error amplifier and the linear ramp signal, which were all necessary in the power factor controller illustrated in FIG. 1.

The non-linear carrier controller 60 includes an integrator 80 for integrating the switch current Is and a carrier generator 74 for generating the non-linear carrier waveform Vc. An anode of a diode 62 is coupled to receive the switch current Is. A cathode of the diode 62 is coupled to a first terminal of a switch 64, to a first terminal of a capacitor 66 and to a positive input to a comparator 68, forming an output of the integrator 80 which provides the integrated signal Vq, representing the current flowing through the switch SW1. A second terminal of the switch 64 is coupled to a second terminal of the capacitor 66 and to ground.

A negative input to an adder circuit 78 is coupled to receive the output voltage Vo, representing the voltage delivered to the load. A positive input to the adder circuit 78 is coupled to receive a reference voltage Vref. A modulating output of the adder circuit 78 is coupled as an input to a voltage-loop error amplifier 76. An output Vm of the voltage-loop error amplifier 76 is coupled as an input to the carrier generator circuit 74. An output of the carrier generator circuit 74 provides the carrier waveform Vc and is coupled to a negative input to the comparator 68. An output of the comparator 68 is coupled to a reset input R of a flip-flop 70. An oscillator 72 provides a clock signal which is coupled to the carrier generator circuit 74 and to a set input S of the flip-flop 70. An inverted output Q of the flip-flop 70 is coupled to control the switch 64. An output Q of the flip-flop 70 is coupled as an input to the gate driver circuit 82. Together, the output Q of the flip-flop 70 and the gate driver circuit 82 control the operation of the switch SW1.

The integrated signal Vq is generated by the integrator 80 in response to the level of the current Is flowing through the switch SW1. The modulating output Vm of the voltage-loop error amplifier 76, representing the difference between the output voltage Vo and the reference voltage Vref, is input to the carrier generator 74 for generating the carrier waveform Vc. The comparator 68 compares the integrated signal Vq to the carrier waveform Vc. The output of the comparator 68 is at a logical low voltage level when the integrated signal Vq is less than the carrier waveform Vc. The output of the comparator 68 is at a logical high voltage level when the integrated signal Vq is greater than the carrier waveform Vc. The output of the comparator 68 is input to the flip-flop 70 and signals when the switch SW1 should be turned off. The oscillator clock signal generated by the oscillator 72 signals when the switch SW1 should be turned on. In this manner, the duty cycle of the switch SW1 is controlled by the nonlinear carrier controller illustrated in FIG. 2.

Other switching power supplies that perform power factor correction using a non-linear carrier are described in: U.S. Pat. No. 5,804,950, entitled, "Input Current Modulation for Power Factor Correction;" U.S. Pat. No. 5,742,151, entitled, "Input Current Shaping Technique and Low Pin Count for PFC-PWM Boost Converter;" and U.S. Pat. No. 5,798,635, entitled, "One Pin Error Amplifier and Switched Soft Start for an Eight Pin PFC-PWM Combination Integrated Circuit Converter Controller."

All of these power supplies which use non-linear carrier control, as in FIG. 2 and the above-mentioned patent documents, provide a simpler implementation for a power factor correction circuit than those that use average current-mode control, as in FIG. 2. They are characterized in that, rather than using ramp signal formed by a constant current as in FIG. 1, the carrier signal is based on the output error voltage signal (at the output of amplifier 76 in FIG. 2). And, the multiplier 20 of FIG. 1 is omitted. Because the shape of the carrier signal and, thus, the switching duty cycle, is determined based on the supply appearing as a resistive load, the input current only loosely follows the input voltage waveform. And, because under light load conditions, the input current can fall to zero (or below), non-linear carrier control tends to be unsuitable for use under light load conditions. In addition, because there is no provision o reduce the input current when the effective input voltage level increases, such non-linear carrier control tends to be unsuitable where the line voltage can vary in amplitude.

Accordingly, there is a need for an improved switching power supply. It is toward these ends that the present invention is directed.

SUMMARY OF THE INVENTION

The present invention is a switching power supply which uses carrier control and input voltage sensing. In one aspect, an output voltage is monitored to form a carrier signal. The carrier signal is compared to a signal that is representative of the input current in order to control the switching duty cycle. In addition, a signal representative of the input voltage is summed with the signal that is representative of the input current, or with the carrier signal, in order to effectively control the switching duty cycle under light load conditions and conditions in which the effect input voltage level can vary. Thus, the invention substantially obtains advantages of prior power factor correction techniques without significant drawbacks.

These and other aspects of the invention are explained in more detail in the following detailed description, accompanying drawings and appended claims.

DETAILED DESCRIPTION OF A PREFERRED EMBODIMENT

Figure 1:
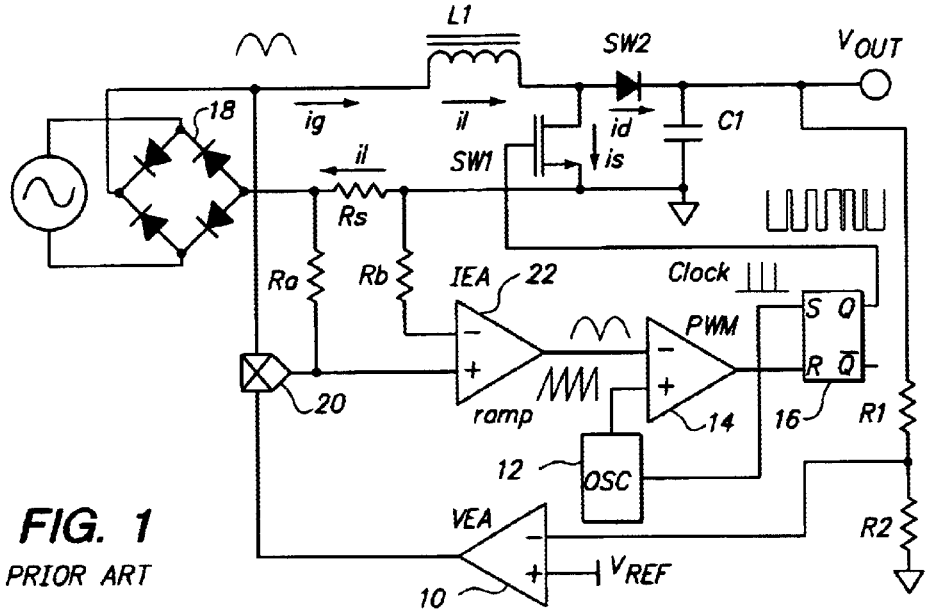
FIG. 1 PRIOR ART
FIG. 1 illustrates a switching power supply which performs power factor correction using average current-mode control.
Figure 2:
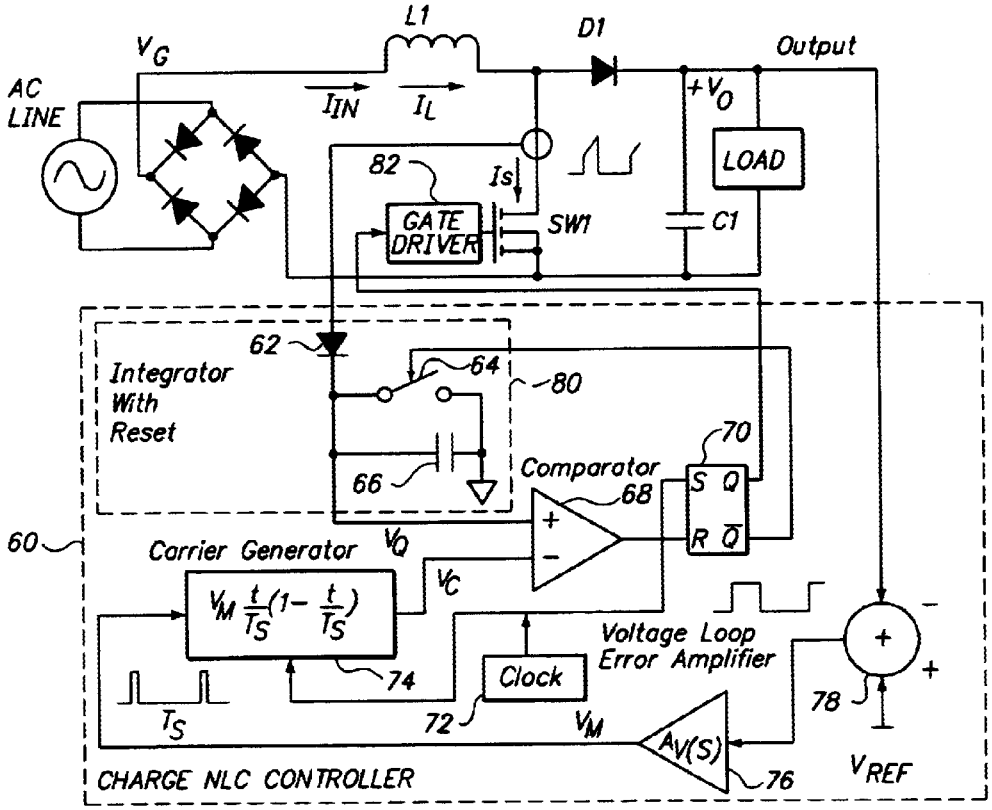
FIG. 2 PRIOR ART
FIG. 2 illustrates a circuit diagram of a switching power supply which performs power factor correction using carrier control.

As shown in the drawings for purposes of illustration, the invention is embodied in a switching power supply for converting power from an alternating-current (AC) power source. Such a switching power supply may be referred to as an off-line power supply. The switching power supply preferably presents a substantially resistive load to the AC power source so as to avoid contaminating the AC source. In other words, the current drawn during the switching operations is substantially in phase with the voltage of the AC source. Power factor correction (PFC) is a technique for ensuring that the input current is in phase with the AC supply voltage.

In one aspect, the switching power supply uses carrier control and input voltage sensing. An output voltage is monitored to form a carrier signal. The carrier signal is compared to a signal that is representative of the input current in order to control the switching duty cycle. In addition, a signal representative of the input voltage is summed with the that is representative of the input current, or with the carrier signal, in order to effectively control the switching duty cycle under light load conditions and conditions in which the effective level of the input voltage can vary (i.e. where the peak level or the root-mean-square level varies). Thus, the invention substantially obtains the advantages of carrier control without the significant drawbacks.

Figure 3:
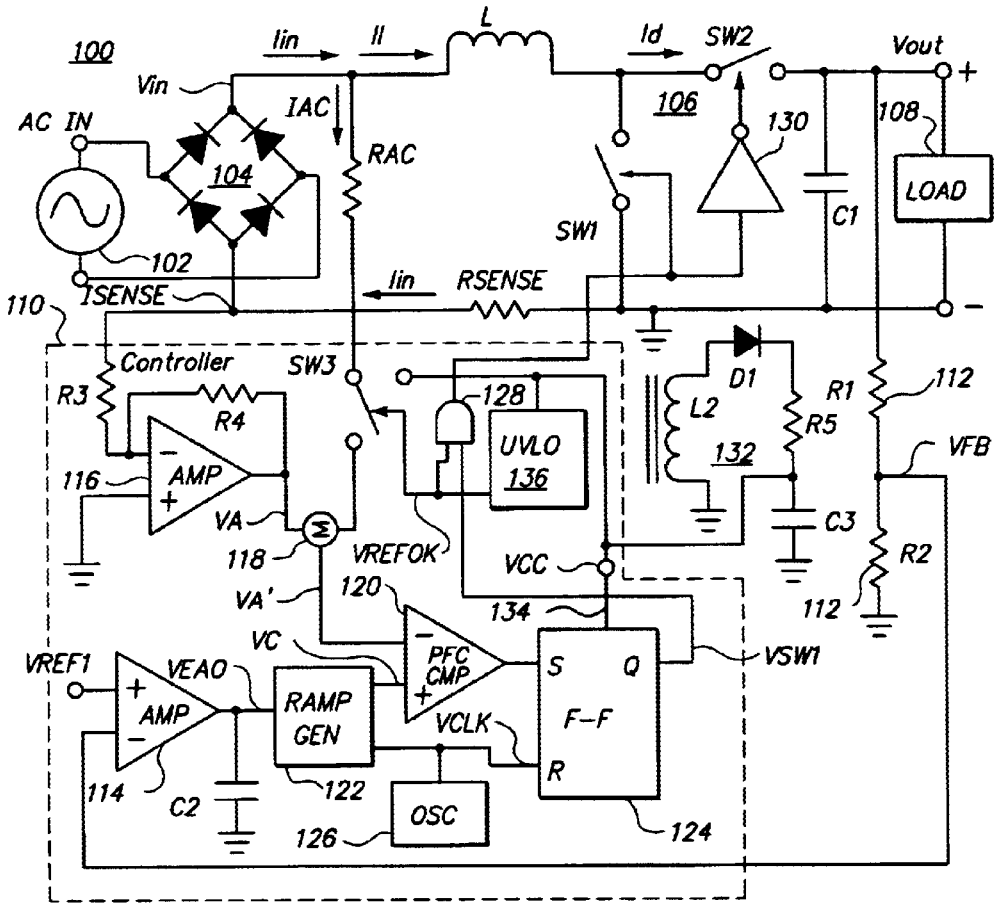
FIG. 3 illustrates a switching power supply in accordance with an aspect of the present invention.

FIG. 3 illustrates a schematic diagram of a switching power supply 100 in accordance with an aspect of the present invention. An alternating-current (AC) source 102 may be coupled across input terminals of a full-wave bridge rectifier 104. A rectified input voltage signal Vin may be formed at a first output terminal of the rectifier 104 and may be coupled to a first terminal of an inductor L1. A second terminal of the inductor L1 may be coupled to a first terminal of a switch SW1 and to a first terminal of a switch SW2. A second terminal of the switch SW2 may be coupled to a first terminal of an output capacitor C1. A second terminal of the switch SW1 and a second terminal of the capacitor C1 may be coupled to a ground node.

The switches SW1, SW2, the inductor L1 and the capacitor C1 form a boost-type switching power converter 106. When the switch SW1 is closed, the switch SW2 is preferably open. Under these conditions, a current Iin from the rectifier 104 may flow through the inductor L1 and through the switch SW1, charging the inductor L1 with energy. Within certain limits, the longer the switch SW1 is closed, the more energy that is stored in the inductor L1: When the switch SW1 is opened, the switch SW2 is preferably closed. Under these conditions, energy stored in the inductor L1 may be discharged through the switch SW2 into the output capacitor C1, forming an output voltage Vout across the capacitor C1. Thus, the level of power delivered to a load 108 which may be coupled to the output capacitor C1 is controlled by controlling the timing of opening and closing the switches SW1 and SW2, such as by pulse-width modulation or frequency modulation. The switch SW2 may be replaced by a freewheeling diode or other rectifier.

A controller 110 includes circuitry for controlling the opening and closing of the switches SW1 and SW2 to regulate the output voltage Vout. The controller 110 receives signal VFB that is representative of the output voltage Vout. The output voltage sensing signal VFB may be formed by a resistor R1 having a first terminal coupled to the output voltage Vout and a second terminal coupled to a first terminal of resistor R2. A second terminal of the resistor R2 may be coupled a ground node. The resistors R1 and R2 form a voltage divider 112 in which the signal VFB is formed at the node between the resistors R1 and R2. The controller 110 may be implemented as an integrated circuit.

The output voltage sensing signal VFB may be coupled to a first input terminal of an amplifier 114, which may be a transconductance amplifier. A reference voltage VREF1 that is representative of a desired level for the output voltage Vout may be coupled to a second input terminal of the amplifier 114. A first terminal of a capacitor C2 may be coupled to the output of the amplifier 114, while a second terminal of the capacitor C2 may be coupled to a ground node. The amplifier 114 serves as an error amplifier which forms an error signal VEAO at its output. Thus, the error signal VEAO is representative of a difference between the output voltage Vout and a desired level for the output voltage.

The error signal VEAO may then be used to affect the duty cycle of the switches SW1 and SW2 in a closed feedback loop. When the output voltage Vout falls, this change is reflected in the error signal VEAO. This change in the error signal VEAO tends to cause the on-time of the switch SW1 to increase (and the off-time of the switch SW2 to decrease) for each switching cycle which tends to increase the current delivered to the output capacitor C1. Conversely, when the output voltage rises, the off-time of the switch SW1 tends to decrease (and the on-time of the switch SW2 tends to increase) which tends to reduce the current delivered to the output capacitor C1.

In a preferred embodiment, the controller 110 performs power factor correction by ensuring that the input current Iin is substantially in phase with the rectified input voltage Vin. So that the input current Iin is maintained in phase with the input voltage Vin the controller 110 may use carrier control for controlling the switches SW1 and SW2. More particularly, for the input current Iin to follow the input voltage Vin, the power converter 100 appears as a resistive load Re. The relationship between Iin, Vin and Re is given as:

$$R_e = V_{in} / I_{in}; \quad (1)$$

Also, the average inductor current I1 is approximately equal to the input current Iin. This relationship can be expressed as:

$$\bar{I}_l = I_{in} \quad (2)$$

In addition, the input instantaneous power is approximately equal to the output instantaneous power, assuming no switching losses: This relationship can be given as:

$$\therefore V_{in} \times \bar{I}_l \approx V_{out} \times \bar{I}_d \quad (3)$$

where Id is the current in the switch SW2. And, for a boost converter the relationship 10 between the input voltage Vin, the output voltage Vout and the switching duty cycle d can be given as:

$$V_{out} / V_{in} = 1 / (1 - d) \quad (4)$$

By rearranging equations (1), (2), (3) and (4), the average current in the switch SW2 can be obtained:

$$\bar{I}_d = I_d \times d' = (1 - d)^2 \times V_{out} / R_e \quad (5)$$

where (1−d)=d'. The average current in the switch SW2 can also be expressed by integrating the current over one switching cycle as:

$$\bar{I}_d = \frac{1}{T_{sw}} \int_0^{T_{off}} I_d(t) \cdot dt \quad (6)$$

Assuming that the value of the inductor L is sufficient large, then the current in the switch SW2 can be approximated as constant during each switching cycle:

$$I_d(t) \sim I_d \quad (7)$$

Then, by combining equation (7) into equation (6), equation (6) becomes:

$$\bar{I}_d = I_d \times t_{off} / T_{sw} = I_d \times d' = I_d \times (1 - d) \quad (8)$$

By substituting equation (8) into equation (5), the following can be obtained:

$$I_d \times d' = (d')^2 \times V_{out} / R_e \quad (9)$$

$$\therefore I_d = d' \times V_{out} / R_e$$

$$\therefore I_d = \frac{V_{out}}{R_e} \times \frac{t_{off}}{T_{sw}}$$

The controller 110 operates essentially by implementing equation (9). Thus, a first terminal of a sensing resistor RSENSE is coupled to the ground node at the second terminal of the switch SW1. A second terminal of the sensing resistor RSENSE is coupled to a second output terminal of the rectifier 104. The input current Iin also flows from this ground node and through the sensing resistor RSENSE before it returns to the rectifier 104. A second terminal of the resistor RSENSE forms a current sensing signal ISENSE that is representative of the input current Iin. The current sensing signal ISENSE is coupled to a first input of an amplifier 116 via a resistor R3.

More particularly, the current sensing signal may be coupled to a first terminal of the resistor R3. A second terminal of the resistor R3 may be coupled to the first input of the amplifier 116 and to a first terminal of a resistor R4. A second terminal of the resistor R4 may be coupled to the output of the amplifier 116, while a second input of the amplifier 116 may be coupled to a ground node.

A signal VA formed at the output of the amplifier 116 is representative of the current Id that passes through the switch SW2 and, thus, represents the left-hand side of equation (9). The signal VA is coupled to control the timing of opening and closing the switches SW1 and SW2. More particularly, the signal VA may be coupled to a first input of a comparator 120 (via a summing element 118, as explained in more detail herein).

The second input terminal of the comparator 120 is coupled to receive a periodic carrier signal VC from a ramp generator 122. The ramp generator 122 receives the error signal VEAO as an input and integrates the signal VEAO. The slope of carrier signal VC formed by the ramp generator 112 depends on the then-current level of the error signal VEAO.

The amplifier 114, ramp generator 122 and comparator 120 essentially implement the right hand side of equation (9). As a result, the duty cycle of a signal formed at the output of the comparator 120 depends on the input current sensing signal Iin and the error signal VEAO. The error signal VEAO is, in turn, representative of the output voltage Vout. The power supply 100, thus, implements carrier control. Thus, unlike the average current-mode controller illustrated in FIG. 1, a multiplier is not required for the supply of FIG. 3. While the input current Iin follows the input voltage Vin based on the assumption of equation (1), that the supply 100 appears as a resistive load to the AC source 102, the input current is not tightly controlled to follow the input voltage in the manner of average current-mode control.

An output of the comparator 120 may be coupled to a set input of a flip-flop or latch 124. An oscillator 126 may form a clock signal VCLK, which is coupled to a reset input of the flip-flop 124. A Q output of the flip-flop 124 may form a switch control signal VSW1 which controls the switches SW1 and SW2. More particularly, the signal VSW1 may be coupled to a first input of a logic AND gate 128. An output of the logic AND gate 128 may be coupled to control switch SW1 and switch SW2 (via signal inverter 130).

The signal VSW1 may be reset to a logical low voltage level upon a leading edge of each pulse in the clock signal VCLK. When the ramp signal VC exceeds the signal VA from the summing element 118, the output of the comparator 120 may set the flip-flop 122 such that the switch control signal VSW1 returns to a logical high voltage level. Thus, the duty cycle of the switches SW1 and SW2 is controlled with negative feedback to maintain the input current Iin in phase with the input voltage Vin and to regulate the output voltage Vout. It will be apparent that leading or trailing edge modulation techniques may be utilized and that other types of modulation may be used, such as frequency modulation.

Because carrier control is used by the power supply 100, it is not necessary to sense the input voltage Vin in order to maintain to input current Iin substantially in phase with the input voltage Vin. However, in accordance with an aspect of the present invention, a first terminal of a resistor RAC is coupled to receive the input voltage Vin. Thus, the first terminal of the resistor RAC may be coupled to the first output terminal of the rectifier 104. A second terminal of the resistor RAC may be coupled to a first input of the summing element 118 via a switch SW3. A voltage sensing current signal IAC which is representative of the input voltage Vin flows through the resistor RAC. Thus, in one position, the switch SW3 connects the current signal IAC to a first input of the summing element 118. In another position, the switch SW3 inhibits the current IAC from flowing to the summing element 118. In certain circumstances, the switch SW3 may be omitted, in which case, the voltage sensing signal IAC may be always coupled to the summing element 118.

The output of the amplifier 116 is coupled to a second input of the summing element 118. Accordingly, the summing element 118 sums the signal IAC with the signal VA which representative of VSENSE to form combined signal VA'. The combined signal VA' is coupled to the input of the comparator 120.

Unlike a conventional average current-mode control scheme, in which it is necessary to sense the input voltage for maintaining the input current in phase with the input voltage, the signal IAC not strictly necessary for this purpose for the supply of FIG. 1. This is apparent by the derivation of equations (1)–(9) above in which it can be seen that the power supply 100 appears as a substantially resistive load Re without having to sense Vin. However, in accordance with an aspect of the present invention, the voltage sensing signal IAC is summed with the signal VA which is representative of the current sensing signal ISENSE. As a result, the duty cycle of a signal formed at the output of the comparator 120 depends on the input current sensing signal Iin, the error signal VEAO and the input voltage sensing signal Vin. This is accomplished without use of a multiplier, as in average current-mode control.

The addition of the signal IAC at the summing element 118 provides certain advantages for carrier control. For example, under light load conditions or under operation in discontinuous conduction mode, the current I1 can fall to zero (or below). As a result, the signal ISENSE may fall to a level that is insufficient for the signal VA, by itself, to trigger the comparator 120 to open and close the switches SW1 and SW2. However, by summing voltage sensing signal IAC at the summing element 118, the signal VA' (at the output of summing element 118) will generally be sufficient to trigger the comparator 120 to open and close the switches SW1 and SW2. As another example, without the signal IAC, the duty cycle of the switches SW1 and SW2 will not generally change in response to changes in the level of the input voltage Vin. As a result, changes in the input voltage Vin can result in unwanted changes in output power provided by the supply 100. However, by summing the voltage sensing signal at the summing element 118, changes in the input voltage level Vin will affect the duty cycle for the switches SW1 and SW2, thereby maintaining a more constant the output power level despite changes in the input voltage Vin.

Figure 4:
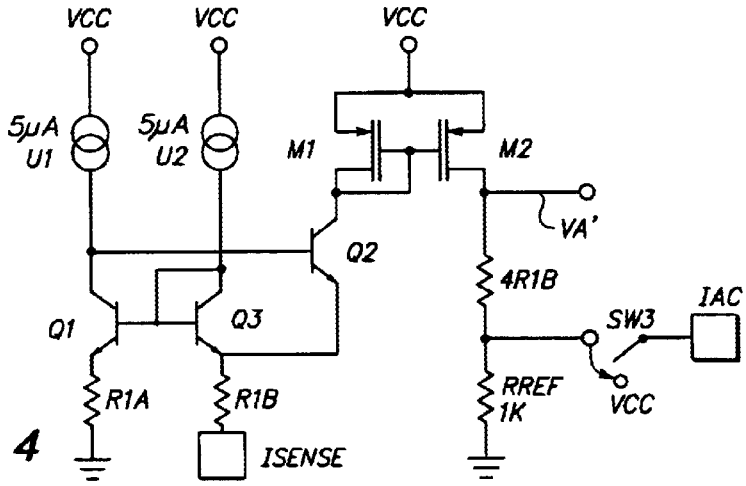
FIG. 4 illustrates an amplifier and summing element of FIG. 3 in more detail.

FIG. 4 illustrates the amplifier 116 and summing element 118 of FIG. 3 in more detail. As shown in FIG. 4, a voltage supply VCC is coupled to a first terminal of a current source U1 and to a first terminal of a current source U2. A second terminal of the current source U1 is coupled to a collector of a transistor Q1 and to a base of a transistor Q2. A second terminal of the current source U2 is coupled to a base of the transistor Q1, to a base of the transistor Q3 and to a collector of the transistor Q3. An emitter of the transistor Q1 is coupled to a first terminal of a resistor R1A. A second terminal of the resistor R1A is coupled to a ground node. An emitter of the transistor Q2 is coupled to an emitter of the transistor Q3 and to a first terminal of a resistor R1B. A second terminal of the resistor R1B is coupled to receive the current sensing signal ISENSE.

The voltage supply VCC is also coupled to a source of a transistor M1 and to a source of a transistor M2. A gate of the transistor M1 is coupled to a gate of the transistor M2, to a drain of the transistor M1 and to a collector of the transistor Q2. A drain of the transistor M2 provides the signal VA'and is coupled to a first terminal of a resistor 4R1A. A second terminal of the resistor 4R1A is coupled to receive the voltage sensing signal IAC (via optional switch SW3) and to a first terminal of a resistor RREF. A second terminal of the resistor RREF is coupled to a ground node.

The current sources U1 and U2 bias the transistors Q1 and Q2 on. When the input current Iin increases, the current sensing signal ISENSE is pulled more negative. As a result current more current is drawn from the transistor M1. This current is mirrored in the transistor M2. As a result, the voltage across the resistor 4R1B increases. Conversely, when the input current Iin is reduced, the voltage across the resistor 4R1B is decreased. The resistance value of 4R1A is preferably four times that of R1A, providing a gain of a factor of four by the amplifier 116, though another gain factor may be selected. In comparison, the signal IAC is preferably not amplified. As result, the signal VA' is more greatly influenced by changes in the current sensing signal ISENSE than by the voltage sensing signal VSENSE. It will be apparent that the amplifier 116 and summing element 118 may be implemented differently than is shown in FIG. 4.

This technique of the present invention of summing an input voltage sensing signal with an input current sensing signal may be employed in other power supplies which use carrier control. As mentioned, while not necessary to maintain the input current in phase with the input voltage for such power supplies, such a technique has certain advantages. Similar advantages can also be obtained by summing an input voltage sensing signal with a carrier signal (shown in FIGS. 6 and 8, below).

Figure 5:
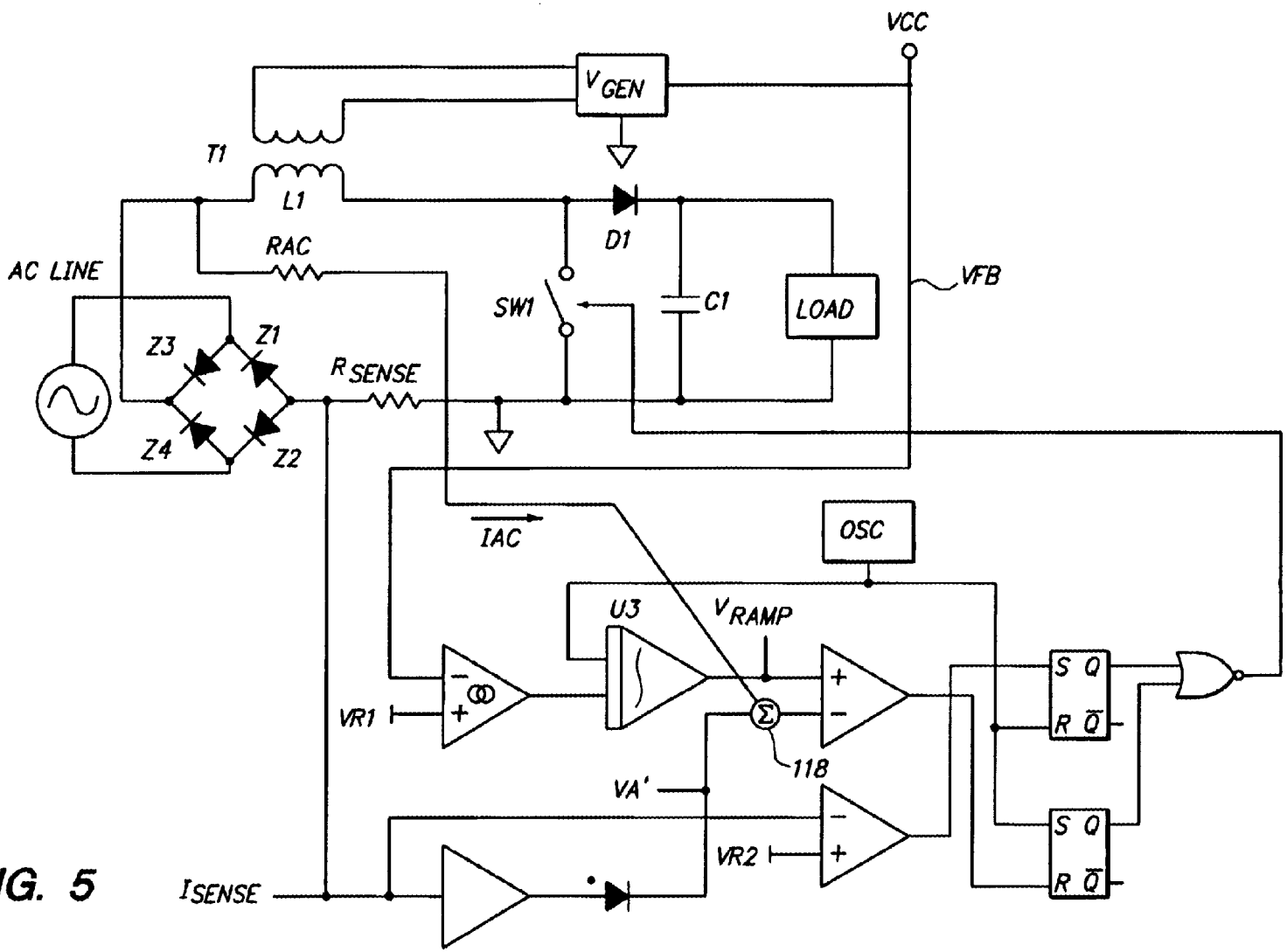
FIG. 5 illustrates an alternate embodiment of a switching power supply in accordance with an aspect of the present invention.

FIG. 5 illustrates an exemplary power supply that uses carrier control and in which an input voltage sensing signal IAC is summed with a signal representative of an input current by a summing element 118 for controlling switching. Operation of the other elements of FIG. 5 is described in U.S. Pat. No. 5,742,151, entitled, "Input Current Shaping Technique and Low Pin Count for PFC-PWM Boost Converter," the contents of which are hereby incorporated by reference.

Figure 6:
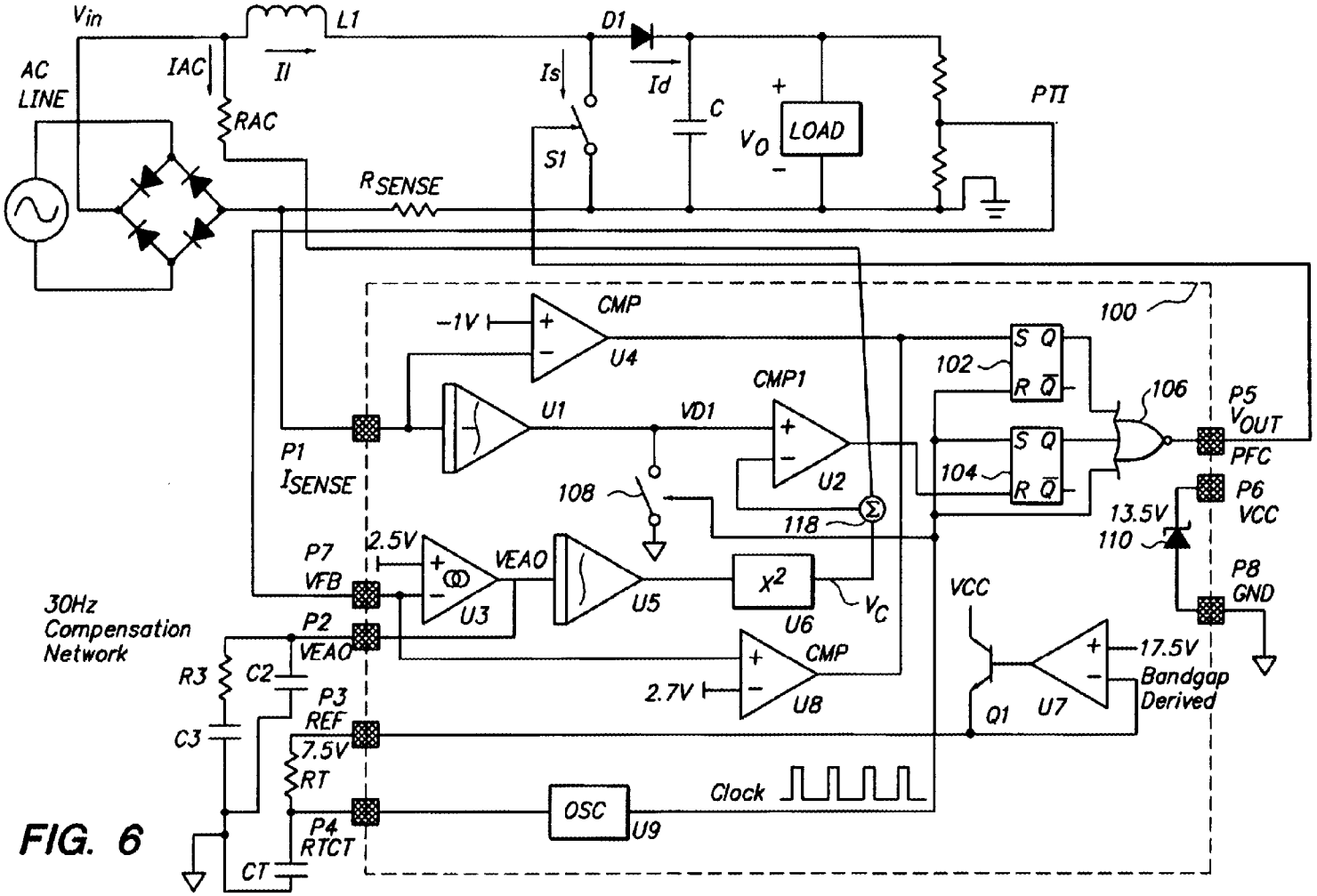
FIG. 6 illustrates another alternate embodiment of a switching power supply in accordance with an aspect of the present invention.

FIG. 6 illustrates an alternate exemplary power supply that uses carrier control and in which an input voltage sensing signal IAC is summed with a carrier signal. The carrier signal is derived from the output voltage via error signal VEAO. The resulting combined signal is applied to an input of comparator CMP1 controlling the switching duty cycle. A current sensing signal is applied to another input of comparator CMP1. Operation of the other elements of FIG. 6 is described in U.S. Pat. No. 5,804,950, entitled, "Input Current Modulation for Power Factor Correction," the contents of which are hereby incorporated by reference.

Due to summing of the input voltage sensing signal IAC with the carrier signal Vc, the squaring element U6 of FIG. 6 can optionally be omitted. Similarly, while such a squaring element is not necessary to be included in the supply 100 of FIG. 3, such a squaring element may be included between the output of generator 122 and the input of comparator 120.

Figure 7A:
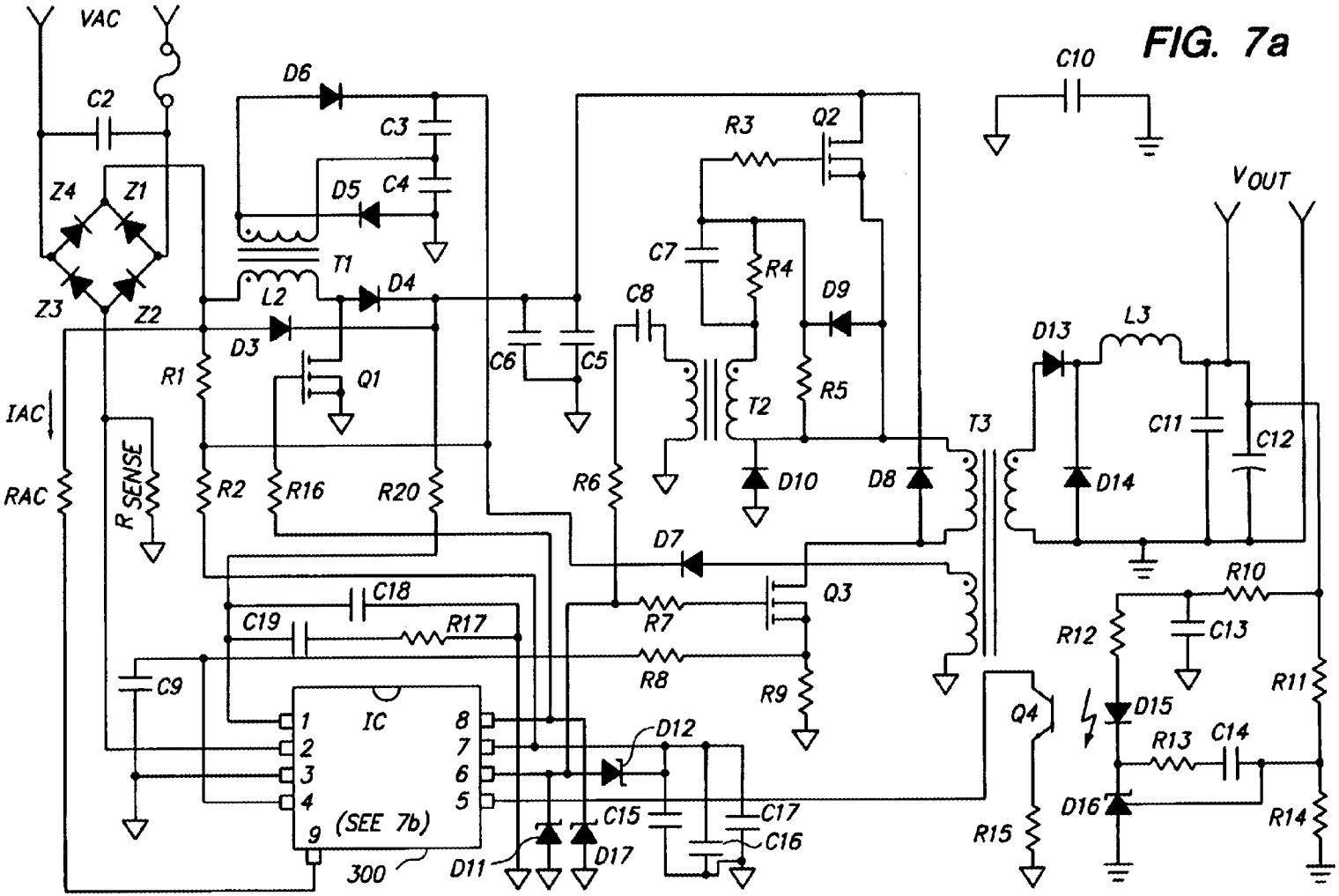
FIGS. 7*a–b* illustrate yet another alternate embodiment of a switching power supply in accordance with an aspect of the present invention.
Figure 7B:
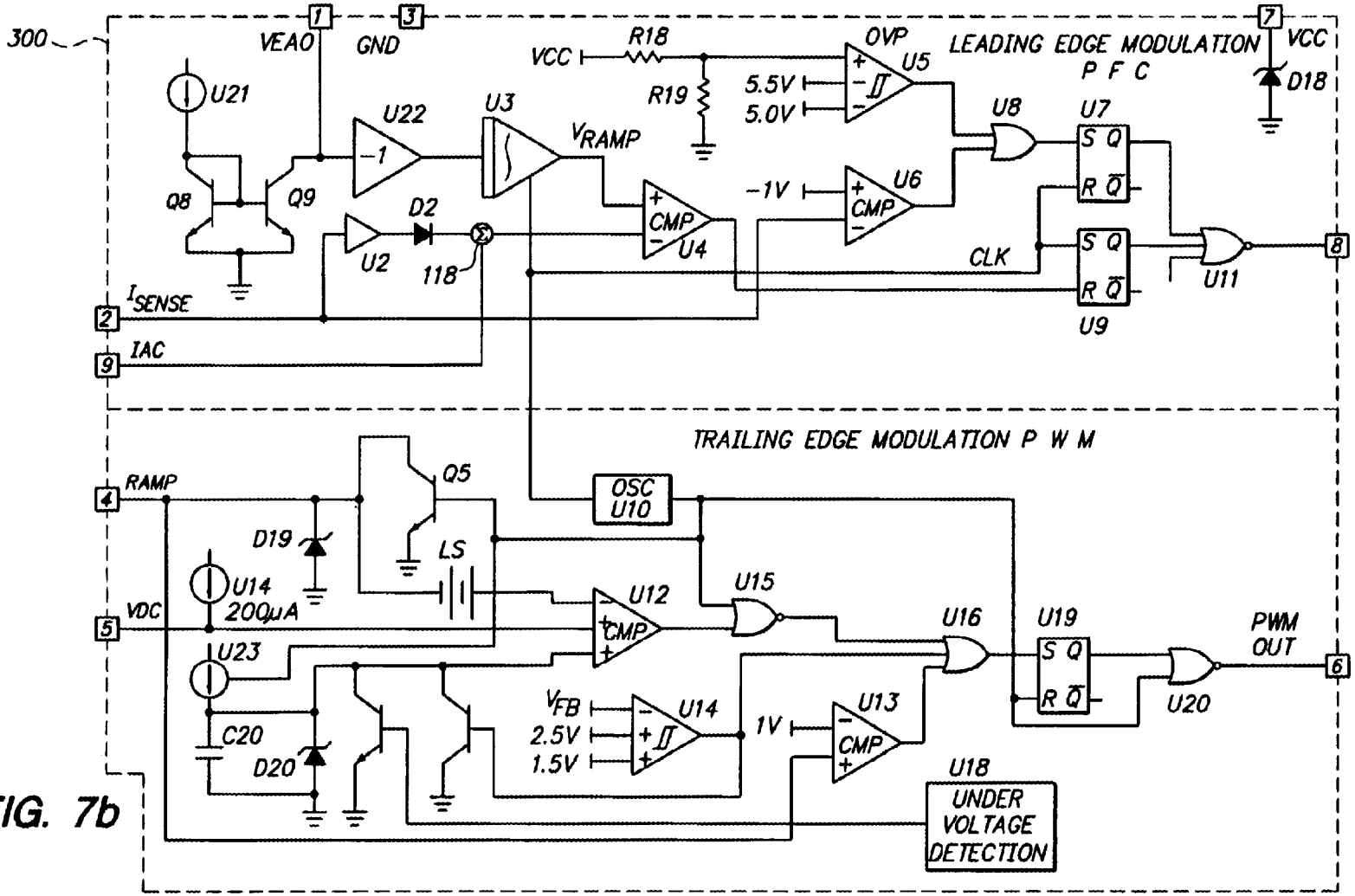

FIGS. 7*a–b* illustrate another alternate exemplary power supply that uses carrier control and in which an input voltage sensing signal IAC is summed with a signal representative of an input current by a summing element 118 for controlling switching. Operation of the other elements of FIG. 6 is described in U.S. Pat. No. 5,798,635, entitled, "One Pin Error Amplifier and Switched Soft-Start for an Eight Pin PFC-PWM Combination Integrated Circuit Converter Controller," the contents of which are hereby incorporated by reference. It should be noted that addition of the input voltage sensing may increase the pin count to nine.

Figure 8:
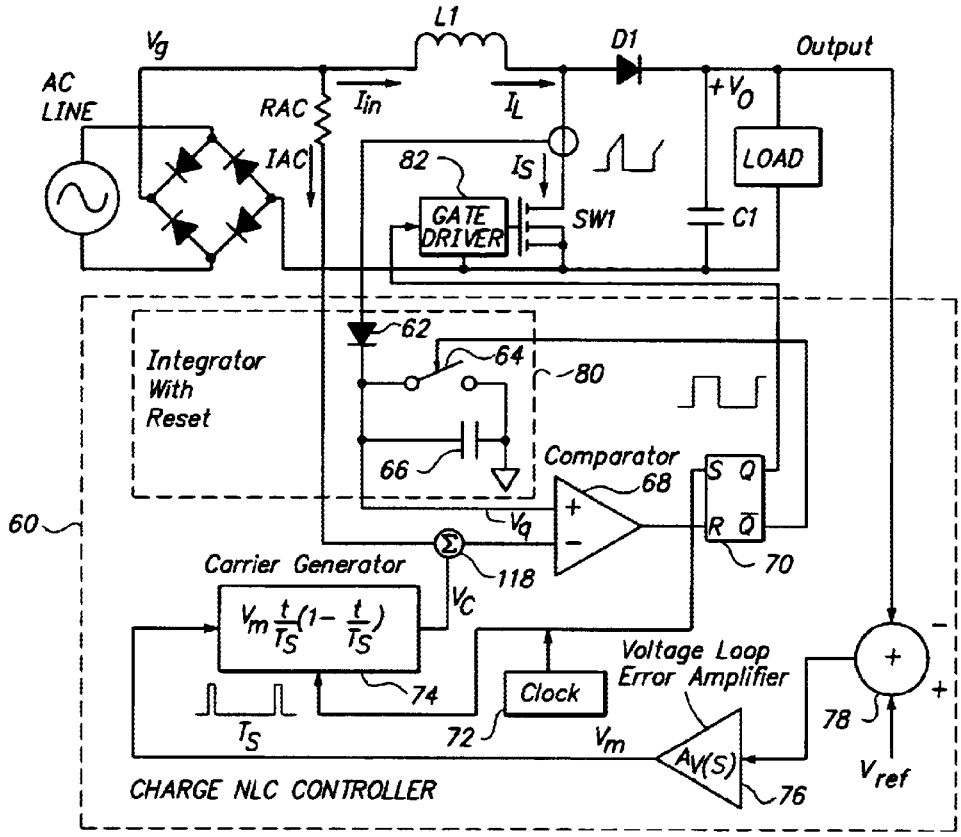
FIG. 8 illustrates still another alternate embodiment of a switching power supply in accordance with an aspect of the present invention.

FIG. 8 illustrates an alternate exemplary power supply that uses carrier control and in which an input voltage sensing signal IAC is summed with a carrier signal. The carrier signal is derived from the output voltage via an error signal formed at the output of error amplifier 76. The resulting combined signal is applied to a comparator 68 for controlling the switching duty cycle.

Returning to FIG. 3, because the controller 110 includes active circuitry, e.g., amplifiers and logic, these elements require power to operate. Accordingly, in one aspect, the switching power supply 100 may be configured to provide this power to the controller 110 by an auxiliary supply 132 which forms a supply voltage VCC.

To provide current to the auxiliary supply 132, the inductor L1 may be inductively coupled to an inductor L2. Thus, the inductor L1 may be implemented as a primary winding of a transformer, while the inductor L2 may be implemented as a secondary winding of the transformer. The inductor L2 may have a first terminal coupled to a ground node and a second terminal coupled to an anode of a diode D1. A cathode of the diode D1 may be coupled to a first terminal of a resistor R5. A second terminal of the resistor R5 may be coupled to a first terminal of a capacitor C3. A second terminal of the second secondary winding L2 and a second terminal of the capacitor C3 may be coupled to a ground node.

Current in the primary winding L1 of the transformer induces current in the secondary winding L2. This induced current is rectified by diode D1 and charges the capacitor C3, forming the supply voltage VCC. The supply voltage VCC provides power for the internal circuitry of the controller 110. For illustration purposes, not all these connections for providing power are shown, however, an exemplary connection 134 is shown by which the flip-flop 124 may receive power from VCC.

When the controller 110 is inactive, the switches SW1 and SW2 are also inactive. Accordingly, induced current in the inductor L2 of the supply 132 does not generate the voltage VCC. To supply power during start-up, the switch SW3 may be configured so that the current through the resistor RAC charges the capacitor C3 of the supply 132 and, thus, this current provides power for the internal circuitry of the controller 100. Accordingly, the default position of the switch SW3 when VCC is not present (or is below a predetermined reference level) is such that the switch SW3 directs the current from the resistor RAC to the capacitor C3. Under these conditions, the resistor RAC serves as a bleed resistor, which "bleeds" current from the source 102 to supply power to the controller 110.

An under-voltage lock-out (UVLO) element 136 is coupled to receive the supply voltage VCC. When the supply voltage VCC is below a predetermined reference level, an output VREFOK of the UVLO 136 is a logic low voltage. The predetermined reference level is preferably set to a level that is sufficient to ensure that the internal components of the controller 110 will have sufficient power to operate reliably. Under these conditions, the switches SW1 and SW2 are inactive and the switch SW3 is in its default position. The VREFOK signal may be coupled to an input of AND gate 128 so as to maintain the switches SW1 and SW2 inactive. Under these conditions, the switch SW1 may be held open, while the switch SW2 may be held closed.

Eventually, the bleed current delivered to the capacitor C3 via the switch SW3 causes the voltage across the capacitor C3 to increase such that the supply voltage VCC is sufficient to reliably provide power to the controller 110. In response to the supply voltage VCC exceeding the reference level of the UVLO 136, the VREFOK output of the UVLO 136 transitions to a logic high voltage. Accordingly, the switch SW3 is conditioned to inhibit the bleed current through the resistor RAC from charging the capacitor C3. Instead, the current through the resistor RAC may be connected to the input of the amplifier 116 for controlling the duty cycle of the switches SW1 and SW2, as explained above.

Also in response to the VREFOK output transitioning to a logic high voltage, the ND gate 128 is conditioned to pass the switch control signal VSW1 to the switches SW1 and SW2 so that they may commence switching. While the switches SW1 are SW2 are active, current is induced in the supply 132 for providing the supply voltage VCC to the controller 110 in place of the bleed current.

Figure 9:
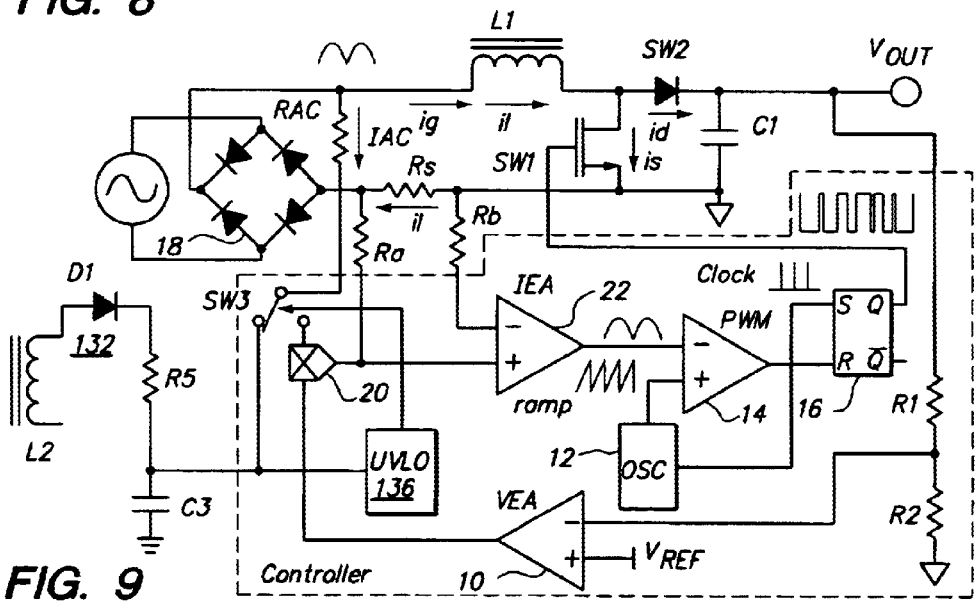
FIG. 9 illustrates a further alternate embodiment of a switching power supply in accordance with an aspect of the present invention.

While the power supply of FIG. 3 uses carrier control, it will be apparent that the switch SW3 and alternate use of the signal IAC may be used in other types of switching power supplies. For example, the switch SW3 may be included in any of the embodiments described herein. As another example, FIG. 9 illustrates a switching power supply that employs average current-mode control and includes the switch SW3 for directing a bleed current to a power supply 132 for forming VCC during start-up. Once VCC exceeds a predetermined level, then the switch SW3 may be conditioned to provide a feed-forward signal to multiplier 20 for maintaining the input current substantially in phase with the input voltage. A UVLO 136 controls the switch SW3 in response to the voltage VCC.

Figure 10:
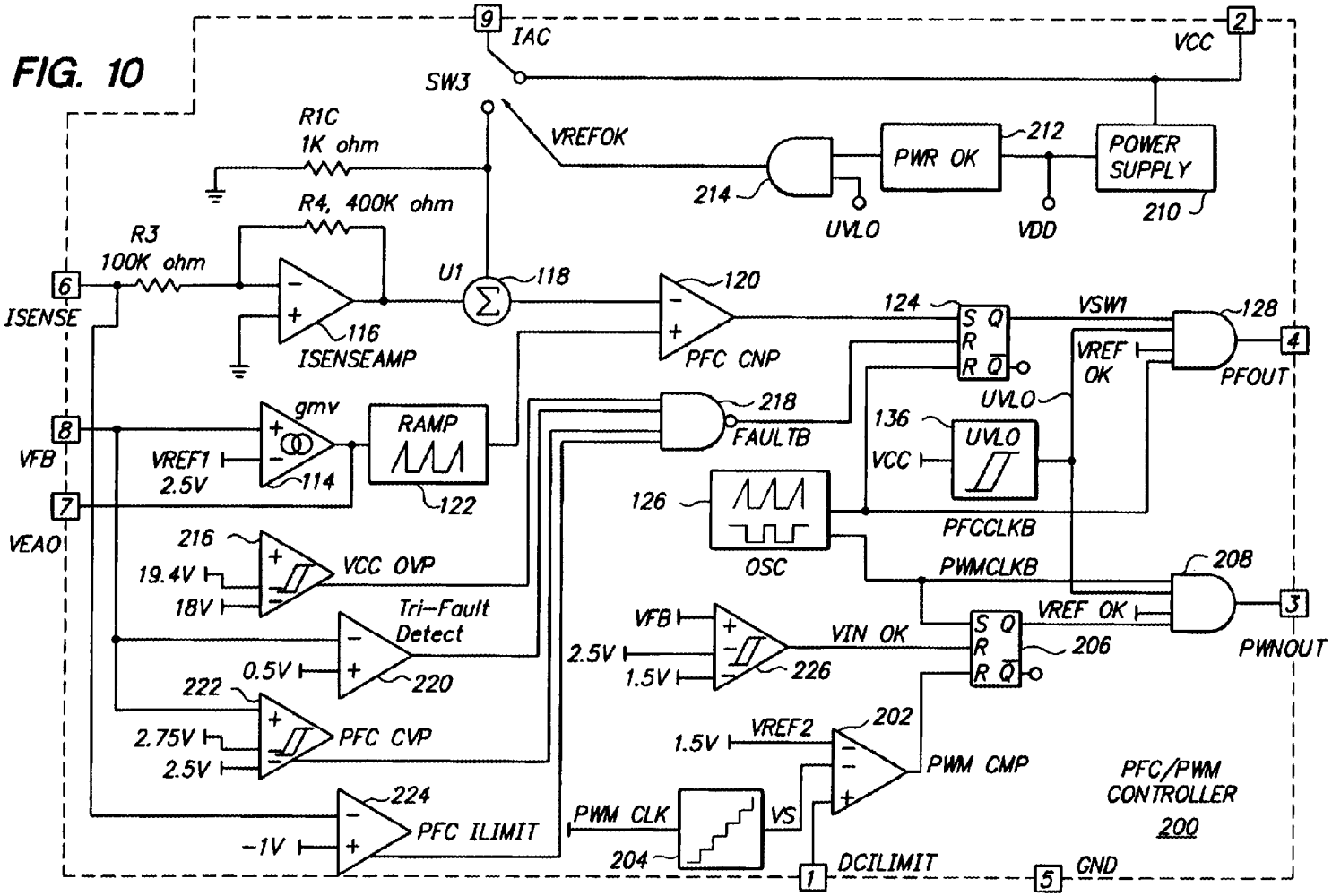
FIG. 10 illustrates a switch controller for a PFC/PWM combination switching power supply in accordance with an embodiment of the present invention.
Figure 11:
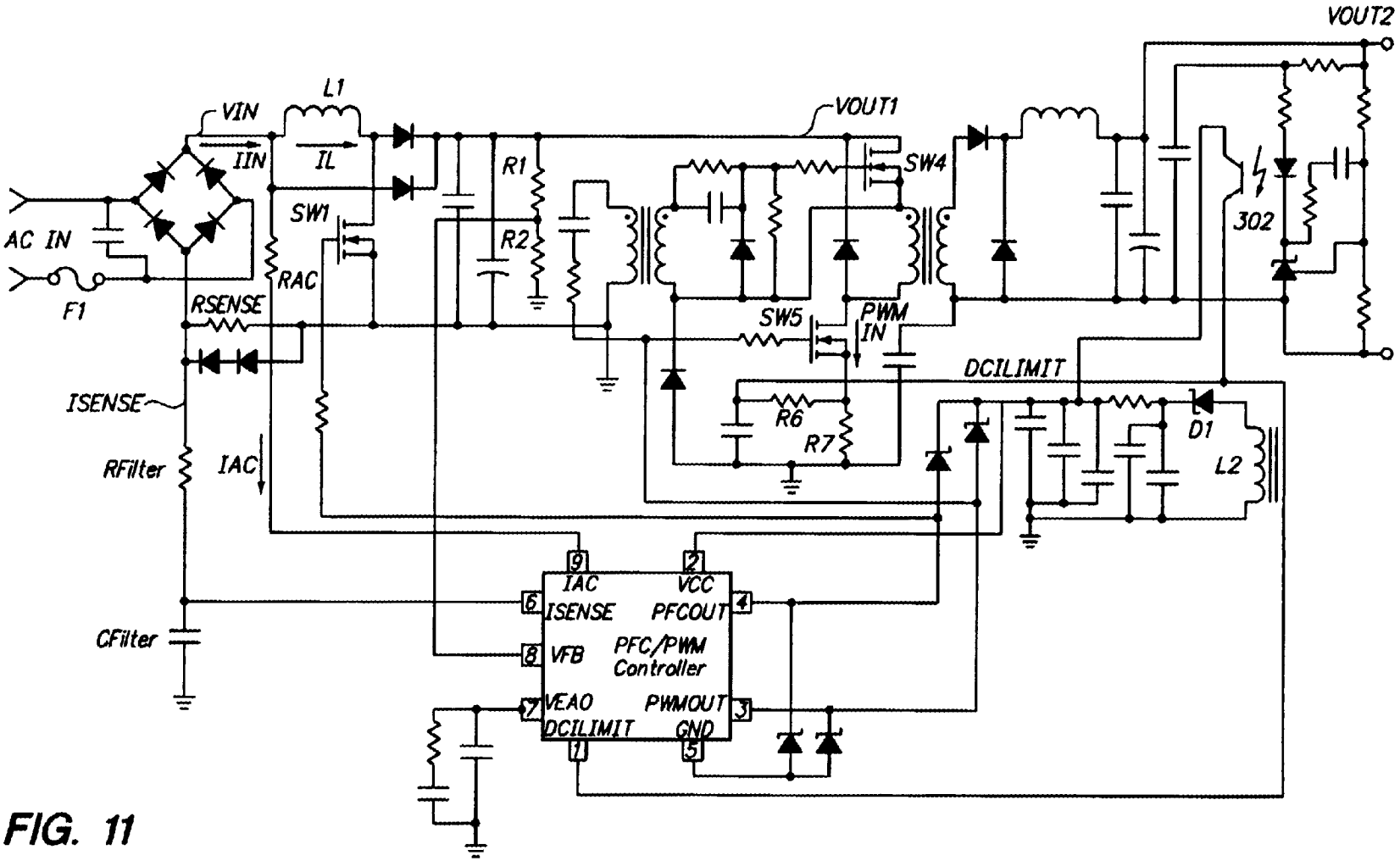
FIG. 11 illustrates exemplary application circuitry that may be used with the controller of FIG. 10.

FIG. 10 illustrates a switch controller 200 for a PFC/PWM combination power supply in accordance with an aspect of the present invention. FIG. 11 illustrates exemplary application circuitry that may be used with the controller of FIG. 10. Elements of FIGS. 10 and 11 that share a functional correspondence with those of FIG. 3 are given the same reference designation. The PFC/PWM combination power supply of FIGS. 10 and 11 differs from the supply of FIG. 3, principally in that the combination supply of FIGS. 10 and 11 has a first power factor correction (PFC) stage, similar to the supply of FIG. 3, which forms an intermediate output voltage Vout1. In addition, the combination supply of FIGS. 10 and 11 has a second, pulse-width modulation stage. The intermediate output voltage Vout1 formed by the PFC stage serves as a source for the PWM stage of the supply, while the PWM stage forms an output voltage Vout2.

As shown in FIGS. 10 and 11, a first terminal of the resistor RAC is coupled to receive the rectified AC input voltage. When the switch SW3 is closed, a second terminal of the resistor RAC is preferably coupled to the first terminal of the resistor R1C and to an input of the summing element 118. A second terminal of the resistor R1C is coupled to a ground node. Accordingly, the resistors RAC and R1C form a resistive divider so as to scale-down the AC input voltage at the summing element 118. In a preferred embodiment, the resistor RAC is approximately 500K ohms, while the resistor R1C is approximately 1K ohms. Accordingly, the switch SW3 is subjected to a relatively low voltage level in comparison to the input voltage Vin.

In addition, the PFC/PWM combination controller 200 includes additional functional elements 202–218 for controlling the PWM stage of the combination supply. More particularly, a feedback signal DCILIMIT is representative of a sum of the output voltage Vout2 and of an input current PWMIN to the PWM stage. The input current PWMIN is modulated by switches SW4 and SW5 of the PWM stage. The output voltage Vout2 is sensed through an optical isolator 302, while the current PWMIN is sensed by forming a voltage across resistors R6 and R7. Because the current PWMIN is substantially a saw tooth waveform, the feedback signal DCILIMIT is substantially a saw tooth waveform that is representative of the input current PWMIN and that is also representative of the output voltage Vout2.

The signal DCILIMIT may be coupled to a first input of a comparator 202. A second input of the comparator 202 may be coupled to receive a reference voltage level VREF2. Accordingly, an output of the comparator 202 forms a signal having a variable duty cycle which depends upon a level of the feedback signal DCILIMIT. A third input of the comparator 202 is coupled to receive a signal VS. During start-up, the signal VS slowly increases so that the switching duty cycle in the PWM stage slowly increases during start-up. Eventually, the signal VS exceeds the reference voltage VREF2. As a result, the duty-cycle of the PWM stage is no longer controlled by the signal VS and is, instead, based on the feedback signal DCILIMIT.

A clock signal from the oscillator 126 may be coupled to a set input of a flip-flop or latch 206, while an output of the comparator 202 may be coupled to a reset input of the flip-flop 206. Thus, upon each leading edge of the clock signal, the Q output is set to a logic high voltage and upon the output of the comparator 202 transitioning to a logic high voltage, the Q output of the flip-flop 206 is reset to a logic low voltage. The Q output controls switching in the PWM stage via a logic AND gate 208. The AND gate 208 forms a signal PWMOUT which controls the switches SW4 and SW5 of the PWM stage. When the output voltage Vout2 falls, the switching duty cycle increases, which tends to increase the output voltage. And, when the output voltage Vout2 increases, the duty cycle is reduced, which decreases the output voltage Vout2. Accordingly, the output voltage Vout2 is regulated.

As shown in FIG. 10, the supply voltage VCC is coupled to an internal power supply conditioner 210. An output of the supply VDD provides power to internal circuitry of the controller 200. The supply conditioner 210 aids in smoothing the voltage VCC such that the output voltage VDD is more suitable for powering the internal circuitry of the controller 200. The supply voltage VDD is coupled to a PWR OK element 212. The PWR OK element functions as a comparator which compares a level of the supply voltage VDD to a predetermined reference level (e.g., 6 volts, where VDD has a nominal value of 7.5 volts). When VDD is below this reference level, an output signal PWR OK formed by the PWR OK element may be logic low level and when VDD is above this reference level, the output signal PWR OK may be a logic high level. The signal PWR OK may then be applied to a first input of a logic AND gate 214, while an output of the UVLO may be coupled to a second input of the logic AND gate 214. An output of the logic AND gate forms the signal VREFOK which controls the switch SW3.

Thus, in order to change the position of the switch SW3 from its position in which bleed current is diverted to provide VCC, the signals PWROK and UVLO must both be a logic high voltage. Accordingly, both VCC and VDD must be above their respective reference levels. As shown in FIG., 10, the signals VREFOK and UVLO are both input to the logic AND gate 128. Thus, both VCC and VDD must be above their respective reference levels for the PFC switch SW1 to be actively switching.

While an internal conditioner 210 is not shown for the controller 110 of FIG. 3, it will be apparent that such an internal supply could be used in the controller 110. Accordingly, for operating the switch SW3 of FIG. 3, the VREFOK signal for the controller 110 may be based on both the level of VCC and the level of VDD. Alternately, the VREFOK signal for either controller 110 or 200 may be independent of the level of VCC (e.g., based only on the level VDD).

In one embodiment, the UVLO 136 of FIGS. 3 and 10 employs hysteresis such that once the supply voltage VCC exceeds the reference level for VCC (e.g., 13 volts, where VCC is nominally 15 volts), it must fall below the reference level by a predetermined amount (e.g., below 10 volts) before the logic state of the UVLO output will change.

In addition, the PFC/PWM combination controller 200 includes additional protective elements 216–224 which protect against various fault conditions which may occur. More particularly, a comparator element 216 disables switching in the PFC stage when the level of VCC becomes excessive by resetting the flip-flop 124 via a logic NAND gate 218. A comparator element 220 disables switching in the PFC stage when the feedback voltage VFB is too low, as may occur if the feedback resistive divider (including resistors R1 and R2) experiences certain open-circuit or short-circuit faults. The comparator element 222 disables switching the PFC stage when the feedback voltage VFB is too high, as may occur if the feedback resistive divider (including resistors R1 and R2) experiences certain other open-circuit or short-circuit faults. The element 224 disables switching the PFC stage when the ISENSE signal and, thus, the input current Iin, is too high. The element 226 disables switching in the PWM stage if the output of the PFC stage, as sensed by the feedback voltage VFB, is too high.

Figure 12:
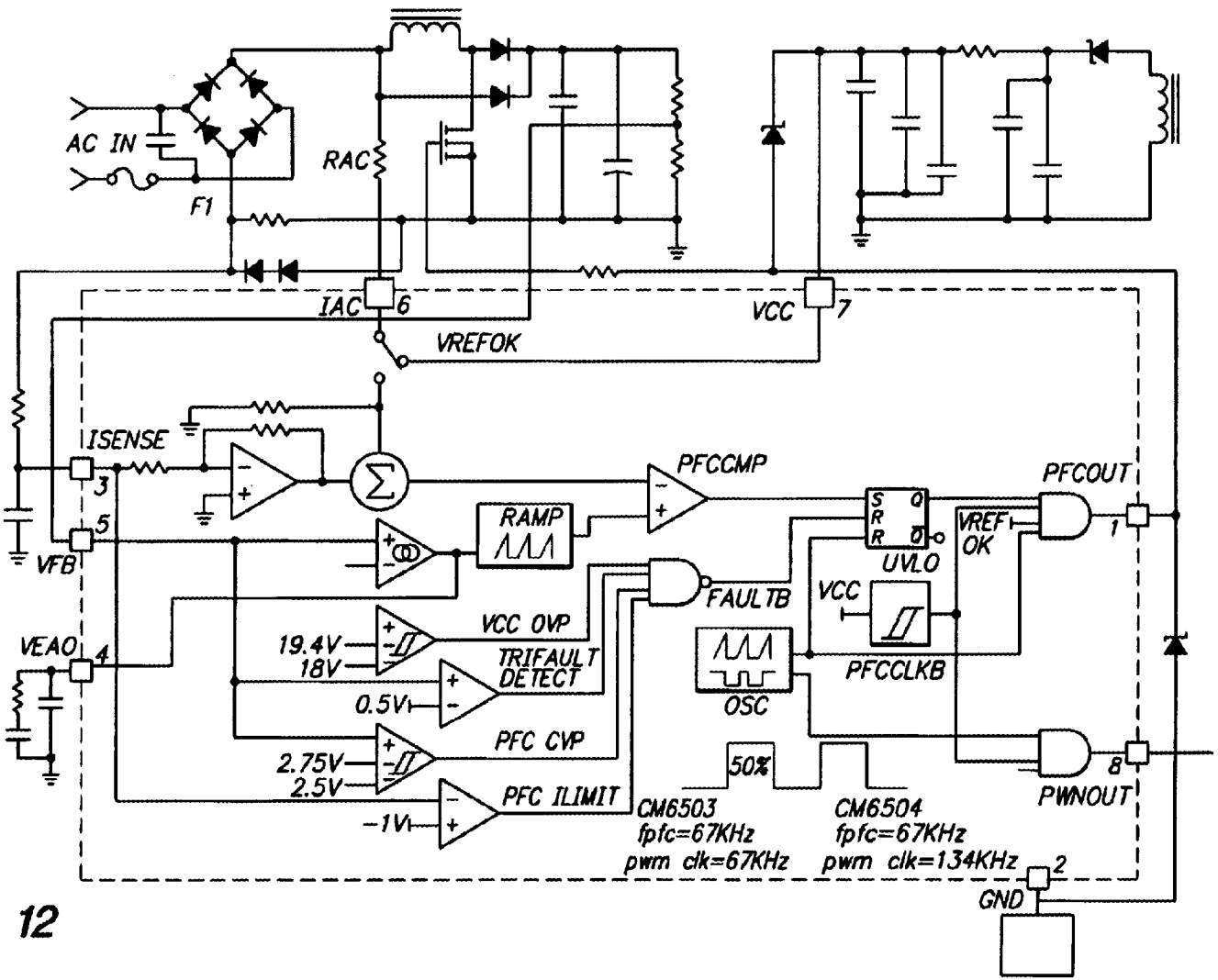
FIG. 12 illustrates an alternate switch controller for a PFC-PWM combination switching power supply in which operation of the PWM is synchronized with that of the PFC stage in accordance with an embodiment of the present invention.

FIG. 12 illustrates an alternate switch controller for a PFC-PWM combination power supply in which operation of a PWM stage is synchronized with that of the PFC stage in accordance with an aspect of the present invention. The controller of FIG. 12 is similar to that of FIG. 10 except that control elements for the PWM stage are omitted and, instead, the output of the AND gate may be used to synchronize external control circuitry (not shown) for a PWM stage.

Thus, a switching power supply has been described, including a two-stage PFC/PWM combination switching power supply. In one aspect, a voltage sensing signal and carrier control are used. In another aspect, the switching power supply makes alternate use of a signal for input voltage sensing or to provide a bleed current for providing power. It will be apparent that various modifications can be made to the embodiments of the switching power supply described herein while still obtaining advantages of the present invention. For example, the feedback circuitry of the controllers 110, 200 disclosed herein which regulates the output voltages and which causes the input current to follow the input voltage can be altered. In addition, the circuit arrangements, including reactive elements, external to the controllers can be altered.

Thus, while the foregoing has been with reference to particular embodiments of the invention, it will be appreciated by those skilled in the art that changes in these embodiments may be made without departing from the principles and spirit of the invention, the scope of which is defined by the appended claims.

What is claimed is:

1. A switching power supply for drawing power from a source and for forming a regulated output voltage, the switching power supply comprising:

a switch for modulating an input current from the source for forming the regulated output voltage by alternately charging and discharging a reactive element;

control circuitry coupled to the switch for controlling operation of the switch by comparing a carrier signal to a signal representative of the input current, wherein the carrier signal is representative of a level of the output voltage; and means for summing an input voltage sensing signal with the signal representative of the input current.

2. The switching power supply according to claim 1, wherein the carrier signal is formed by integrating a signal that is representative of a difference between the output voltage and a desired level for the output voltage.

3. The switching power supply according to claim 1, wherein the carrier signal is formed by integrating a signal that is representative of a difference between the output voltage and a desired level for the output voltage and squaring a result of the integrating.

4. The switching power supply according to claim 1, further comprising means for inhibiting the input voltage sensing signal.

5. The switching power supply according to claim 4, wherein said means for inhibiting diverts a bleed current for supplying current from the source to the control circuitry.

6. The switching power supply according to claim 1, wherein said switching power supply forms a first, power factor correction stage and further comprising a second, pulse-width modulation stage coupled to receive the output voltage.

7. The switching power supply according to claim 6, wherein switching in the second, pulse-width modulation stage is synchronized with switching in the power factor correction stage.

8. A switching power supply for drawing power from a source and for forming a regulated output voltage, the switching power supply comprising:

a switch for modulating an input current from the source for forming the regulated output voltage by alternately charging and discharging a reactive element;

control circuitry coupled to the switch for controlling operation of the switch by comparing a carrier signal to a signal representative of the input current, wherein the carrier signal is representative of a level of the output voltage; and means for summing an input voltage sensing signal with the carrier signal.

9. The switching power supply according to claim 8, wherein the carrier signal is formed by integrating a signal that is representative of a difference between the output voltage and a desired level for the output voltage.

10. The switching power supply according to claim 8, wherein the carrier signal is formed by integrating a signal that is representative of a difference between the output voltage and a desired level for the output voltage and squaring a result of the integrating.

11. The switching power supply according to claim 8, further comprising means for inhibiting the input voltage sensing signal.

12. The switching power supply according to claim 11, wherein said means for inhibiting diverts a bleed current for supplying current from the source to the control circuitry.

13. The switching power supply according to claim 8, wherein said switching power supply forms a first, power factor correction stage and further comprising a second, pulse-width modulation stage coupled to receive the output voltage.

14. The switching power supply according to claim 13, wherein switching in the second, pulse-width modulation stage is synchronized with switching in the power factor correction stage.

15. A switching power supply for drawing power from a source and for forming a regulated output voltage, the switching power supply comprising:

a switch for modulating an input current from the source for forming the regulated output voltage by alternately charging and discharging a reactive element;

control circuitry coupled to the switch for controlling a duty cycle of the switch so that the input current is maintained substantially in-phase with an AC input voltage provided by the source without having to multiply an input voltage sensing signal with a signal representative of the output voltage; and means for adjusting the duty cycle of the switch in response to changes in the effective level of the AC input voltage the means for adjusting coupled to the control circuitry.

16. The switching power supply according to claim 15, wherein the means for adjusting comprises a summing element for summing the input voltage sensing signal with a signal representative of the input current.

17. The switching power supply according to claim 16, wherein the control circuitry comprise a signal generator for forming a periodic carrier signal based on an error signal that is representative of a difference between the output voltage and a desired level for the output voltage.

18. The switching power supply according to claim 17, wherein the carrier signal is formed by integrating a signal that is representative of a difference between the output voltage and a desired level for the output voltage.

19. The switching power supply according to claim 17, wherein the carrier signal is formed by integrating a signal that is representative of a difference between the output voltage and a desired level for the output voltage and squaring a result of the integrating.

20. The switching power supply according to claim 18, wherein the control circuitry further comprise a comparator for comparing an output of the summing element to the carrier signal to the periodic carrier signal, wherein an output of the comparator controls operation of the switch.

21. The switching power supply according to claim 15, wherein the control circuitry comprise a signal generator for forming a periodic carrier signal based on an error signal that is representative of a difference between the output voltage and a desired level for the output voltage.

22. The switching power supply according to claim 21, wherein the means for adjusting comprises a summing element for summing the input voltage sensing signal with the periodic carrier signal.

23. The switching power supply according to claim 22, wherein the carrier signal is formed by integrating a signal that is representative of a difference between the output voltage and a desired level for the output voltage.

24. The switching power supply according to claim 23, wherein the control circuitry further comprise a comparator for comparing an output of the summing element to a signal representative of the input current, wherein an output of the comparator controls operation of the switch.

25. The switching power supply according to claim 21, wherein the carrier signal is formed by integrating a signal that is representative of a difference between the output voltage and a desired level for the output voltage and squaring a result of the integrating.

26. The switching power supply according to claim 25, wherein the control circuitry further comprise a comparator for comparing an output of the summing element to a signal representative of the input current, wherein an output of the comparator controls operation of the switch.

27. The switching power supply according to claim 15, further comprising means for inhibiting the input voltage sensing signal.

28. The switching power supply according to claim 27, wherein said means for inhibiting diverts a bleed current for supplying current from the source to the control circuitry.

29. The switching power supply according to claim 15, wherein said switching power supply forms a first, power factor correction stage and further comprising a second, pulse-width modulation stage coupled to receive the output voltage.

30. The switching power supply according to claim 29, wherein switching in the second, pulse-width modulation stage is synchronized with switching in the power factor correction stage.

31. A switching power supply for drawing power from a source and for forming a regulated output voltage, the switching power supply comprising:

a switch for modulating an input current from the source for forming the regulated output voltage by alternately charging and discharging a reactive element;

an error amplifier for forming an error signal that is representative of a difference between the output voltage and a desired level for the output voltage;

a signal generator for forming a periodic carrier signal based on the error signal;

an input current sensing amplifier for forming a signal that is representative of the input current;

a summing element for summing the signal that is representative of the input current with a signal that is representative of the input voltage, thereby forming a combined signal; and a comparator for comparing the combined signal to the periodic carrier signal, wherein an output of the comparator controls operation of the switch.

32. The switching power supply according to claim 31, wherein the signal generator forms the carrier signal by integrating the error signal.

33. The switching power supply according to claim 31, further comprising means for inhibiting the input voltage sensing signal.

34. The switching power supply according to claim 33, wherein said means for inhibiting diverts a bleed current for supplying current from the source to the control circuitry.

35. The switching power supply according to claim 31, wherein said switching power supply forms a first, power factor correction stage and further comprising a second, pulse-width modulation stage coupled to receive the output voltage.

36. The switching power supply according to claim 35, wherein switching in the second, pulse-width modulation stage is synchronized with switching in the power factor correction stage.

37. The switching power supply according to claim 31, wherein said input current amplifier and summing element comprise:

first and second current sources for biasing each of first and second transistors on;

a first resistor having a first terminal coupled to receive current from one of the transistors of the first pair and a second terminal coupled to receive an input current sensing signal;

a third and fourth transistors wherein current through the first resistor passes through the third transistor and is mirrored in the fourth transistor;

a second and third resistors coupled in series wherein a first terminal of the second transistor is coupled to the fourth transistor and a second terminal of the second resistor is coupled to the third resistor by an intermediate node wherein the input voltage sensing signal is coupled to the intermediate node and wherein the combined signal is formed at the first terminal of the second resistor.

38. A switching power supply for drawing power from a source and for forming a regulated output voltage, the switching power supply comprising:

a switch for modulating an input current from the source for forming the regulated output voltage by alternately charging and discharging a reactive element;

an error amplifier for forming an error signal that is representative of a difference between the output voltage and a desired level for the output voltage;

a signal generator for forming a periodic carrier signal based on the error signal;

an input current sensing amplifier for forming a signal that is representative of the input current;

summing element for summing the periodic carrier signal with a signal that is representative of the input voltage, thereby forming a combined signal; and a comparator for comparing the combined signal to the signal that is representative of the input current, wherein an output of the comparator controls operation of the switch.

39. The switching power supply according to claim 38, wherein the signal generator forms the carrier signal by integrating the error signal.

40. The switching power supply according to claim 38, further comprising means for inhibiting the input voltage sensing signal.

41. The switching power supply according to claim 40, wherein said means for inhibiting diverts a bleed current for supplying current from the source to the control circuitry.

42. The switching power supply according to claim 38, wherein said switching power supply forms a first, power factor correction stage and further comprising a second, pulse-width modulation stage coupled to receive the output voltage.

43. The switching power supply according to claim 42, wherein switching in the second, pulse-width modulation stage is synchronized with switching in the power factor correction stage.

* * * * *